US007434880B2

(12) United States Patent
Rønnestad

(10) Patent No.: US 7,434,880 B2
(45) Date of Patent: Oct. 14, 2008

(54) MOBILE JOINT SUITABLE FOR A SITTING DEVICE

(75) Inventor: Tor Rønnestad, Alesund (NO)

(73) Assignee: Varier Furniture AS, Skodje (NO)

( * ) Notice: Subject to any disclaimer, the term of this patent is extended or adjusted under 35 U.S.C. 154(b) by 140 days.

(21) Appl. No.: 10/538,677

(22) PCT Filed: Dec. 22, 2003

(86) PCT No.: PCT/NO03/00438

§ 371 (c)(1),
(2), (4) Date: Dec. 9, 2005

(87) PCT Pub. No.: WO2004/056238

PCT Pub. Date: Jul. 8, 2004

(65) Prior Publication Data

US 2006/0138837 A1 Jun. 29, 2006

(30) Foreign Application Priority Data

Dec. 20, 2002 (NO) ..... 20026157

(51) Int. Cl.
*A47C 1/02* (2006.01)

(52) U.S. Cl. ..... 297/313

(58) Field of Classification Search ..... 297/313, 297/314, 325, 302.1, 337, 296, 297
See application file for complete search history.

(56) References Cited

U.S. PATENT DOCUMENTS

| | | | | | |
|---|---|---|---|---|---|
| 1,737 | A * | 8/1840 | King | 297/313 |
| 138,461 | A * | 4/1873 | Winchester | 248/596 |
| 216,753 | A * | 6/1879 | Ordway | 248/370 |
| 482,745 | A * | 9/1892 | Lewis | 297/130 |
| 2,799,323 | A * | 7/1957 | Berg | 297/312 |
| 2,818,911 | A * | 1/1958 | Syak | 248/575 |
| 2,828,801 | A * | 4/1958 | Papst | 248/629 |
| 4,119,343 | A | 10/1978 | Pentzien | |
| 4,141,530 | A * | 2/1979 | Ward | 248/592 |
| 4,371,142 | A * | 2/1983 | Bottemiller et al. | 248/573 |
| 4,736,984 | A | 4/1988 | Tacker | |
| 5,775,774 | A * | 7/1998 | Okano | 297/300.2 |
| 6,827,401 | B2 * | 12/2004 | Marshall et al. | 297/302.1 |

FOREIGN PATENT DOCUMENTS

| | | |
|---|---|---|
| DE | 1778172 | 4/1968 |
| EP | 0651958 | 8/1988 |
| EP | 0651958 | 11/1994 |

(Continued)

*Primary Examiner*—Joseph F Edell
(74) *Attorney, Agent, or Firm*—Kolisch Hartwell, P.C.

(57) ABSTRACT

The present invention relates to a mobile joint (1) with spring resistance, suitable for a sitting device, comprising a first and a second joint element (10, 20), which are pivotally connected by a shaft (3), to allow tilting of the sitting device caused by the displacement of the users weight, comprising a first and a second parallel plate spring (18, 19) with first and second ends, with an intermediate blocking element (11), wherein each plate spring (18, 19) in the first end are connected to the first joint element (10), and in the second end are glidingly abutting the second joint element (20), the first and second plate spring (18, 19) each having an axis of rotation that is displaced in relation to each other and the shaft (3).

8 Claims, 5 Drawing Sheets

FOREIGN PATENT DOCUMENTS

| | | |
|---|---|---|
| EP | 0820713 | 7/1997 |
| FR | 2267068 | 11/1975 |
| GB | 1299740 | 12/1972 |
| RU | 1823787 | 6/1993 |
| WO | WO93/19648 | 10/1993 |

* cited by examiner

MOBILE JOINT SUITABLE FOR A SITTING DEVICE

FIELD OF THE INVENTION

The present invention relates to a simple and compact moveable joint with spring resistance suitable for use in furniture such as a chair.

PRIOR ART

Several types of chairs comprising moveable joints connecting a seat and an underframe are known in the art, particularly in office chairs. These chairs often have a resting position and two extreme end positions, a stooping position and a more laid-back position. The chairs are often provided with a complex joint comprising spring means, in order to obtain the ability to tilt the chair seat between the said positions, and to bring the seat back to its intermediate resting position.

For example, FR 2267068 describes a conventional joint used in office chairs wherein a leaf spring is used to provide resistance against the tilting action. However, this type of joint using steel leaves, is dependent on several leafs of relative great lengths in order to provide the mentioned resistance. The joint is therefore highly visible, difficult to integrate in furniture, such as a chair, and produces a large spring travel. In addition the joint according to FR 2267068 only provides resistance in one tilting direction and has no stopping device limiting the swing.

Furthermore, numerous different armchairs and recliners exist with tilting backrest wherein pivoted joints or rails in different embodiments are used to provide a similar movement. Friction- or spring means may be used to provide resistance to such movement. The mechanisms in these chairs to tilt the chair seat are also complex and sometimes visible on the furniture.

Joints of this kind have also been integrated in the seat of the chair utilizing the padding of the seat to provide a spring-like effect to the joint. This makes it possible to create a joint which is less complex and smaller. The problem encountered with this solution is that relatively large forces must be absorbed by the padding material without deformation; hence the material must be relatively compact to provide sufficient resistance. Padding of this kind is not particularly comfortable and it has proven difficult to provide a padding which also has sufficient strength. To obtain sufficient strength, an alternative solution has been to compensate with additional padding, but this results in a bulkier piece of furniture and affects the appearance of the furniture.

In GB 1299740, a joint is described with a stiff elastic padding providing resistance against the tilting of the two joint elements. However, this solution provides a very limited and imprecise tilting and also allows an unfavourable rotation in the horizontal plane of the joint elements in relation to each other. The padding is subjected to aging and wear, especially when under tension, which changes the elastic properties of the padding. With time, the joint will end up resting on the main bolt connecting the two joint elements and subjecting it to damageable wear, if not regularly tightened. Such tightening will again restrict the tilting angle.

Tilting of a chair seat is desirable for several reasons. In office chairs, the chair adapts better to the sitting position of the user depending on the users movement. Such a dynamic and varying sitting position is more ergonomically favourable for the body than a static sitting position. Tilting of the chair seat therefore feels more comfortable, and gives the user a feeling of quality since the chair is less strenuous to sit on.

It is therefore desirable to pursue this quality in simpler chairs such as chairs for use at dining tables or conference chairs etc. The disadvantage of current solutions is that the joints are complex and heavy devices which are not easily adapted to chairs where a simple design, light weight and for example the possibility to stack the chairs, is desired.

Thus, there is currently a need for a small and simple joint with spring resistance, being light in weight, for simpler chairs where the seat and optionally the back of the chair may be tilted to extreme positions, and return to a rest position when the chair is not in use.

SUMMARY OF THE INVENTION

The object of the present invention is to provide a joint for a chair which eliminates the above problems and addresses the deficiencies that earlier solutions had.

The object of the invention is achieved by a mobile joint (1) with spring resistance, as defined in the patent claims, suitable for a sitting device, comprising a first and second joint element (10,20), which are pivotally connected by a shaft (3), to allow tilting of the sitting device caused by the displacement of the users weight, comprising a first and second parallel plate spring (18,19) with first and second ends, with an intermediate blocking element (11), wherein each plate spring (18,19) in the first end are connected to the first joint element (10), and in the second end are glidingly abutting the second joint element (20), the first and second plate spring (18,19) each having an axis of rotation that is displaced in relation to each other and the shaft (3).

The joint according to the present invention consists of few parts, provides novel use of materials such as glass fibre or composite material in the springs thus enabling a compact joint with good functionality in relation to wear.

The joint provides great stiffness with only two spring elements, as well as small spring travel providing good resistance against exhaustion. In addition the plate springs of the present joint may easily be changed for repair or adaptation to the user.

The joint of the present invention may have a near cubic form and may easily be fitted in a variation of constructions and be mounted upside down, side ways or in any other angle.

The joint may therefore be produced and assembled at low costs by standard production equipment, which may easily be automated, and represents low costs in transportation and storage due to its small size and light weight.

DETAILED DESCRIPTION

A preferred embodiment of the invention will now be described in detail, with reference to the figures. The embodiment is an example of the invention and is not intended to limit the scope of the invention.

In the following description the expressions "front" and "forward" describes the direction the user faces when she or he is seated with their back towards the back of the chair in a normal way, and the expressions "rear" and "back" refer to the opposite direction, unless otherwise stated.

Furthermore, reference to the angle of the joint refers to the angle between the seat surface and the ground, e.g. the floor. In the demonstrated embodiments, this angle corresponds to the angle between the upper and the lower face of the described joint, but this will not always be the case in alternative embodiments of the joint.

EXAMPLE EMBODIMENT

Figure 1:
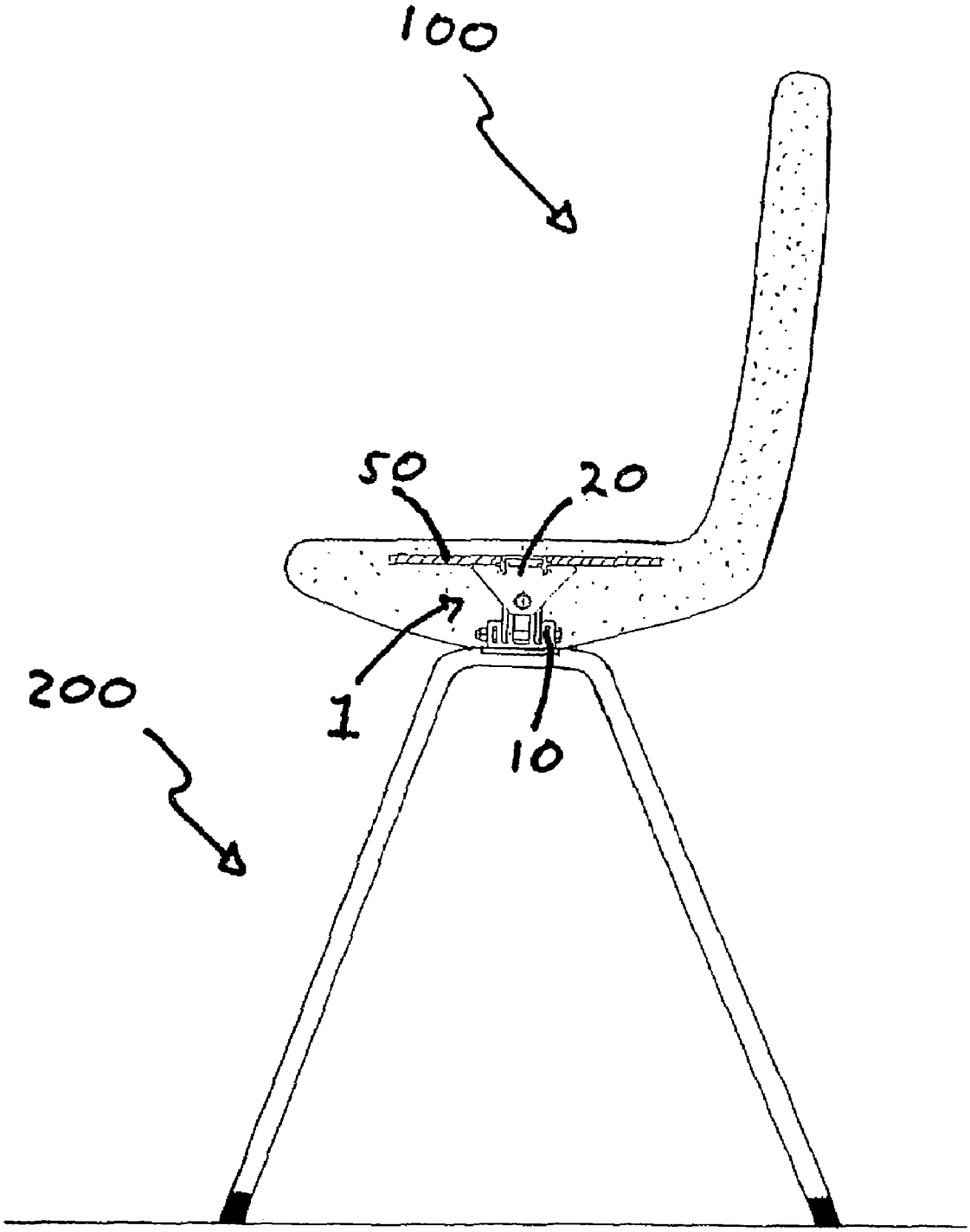
FIG. 1 shows a phantom view of a chair with a joint according to the invention integrated in a chair seat and attached to an underframe.

As shown in FIG. 1, the joint 1 according to the invention, is suitable as a connecting joint between a chair seat and an underframe 200. The underframe 200 comprises four legs joined in an upper mounting suitable to attach the seat of the chair.

Figure 2:
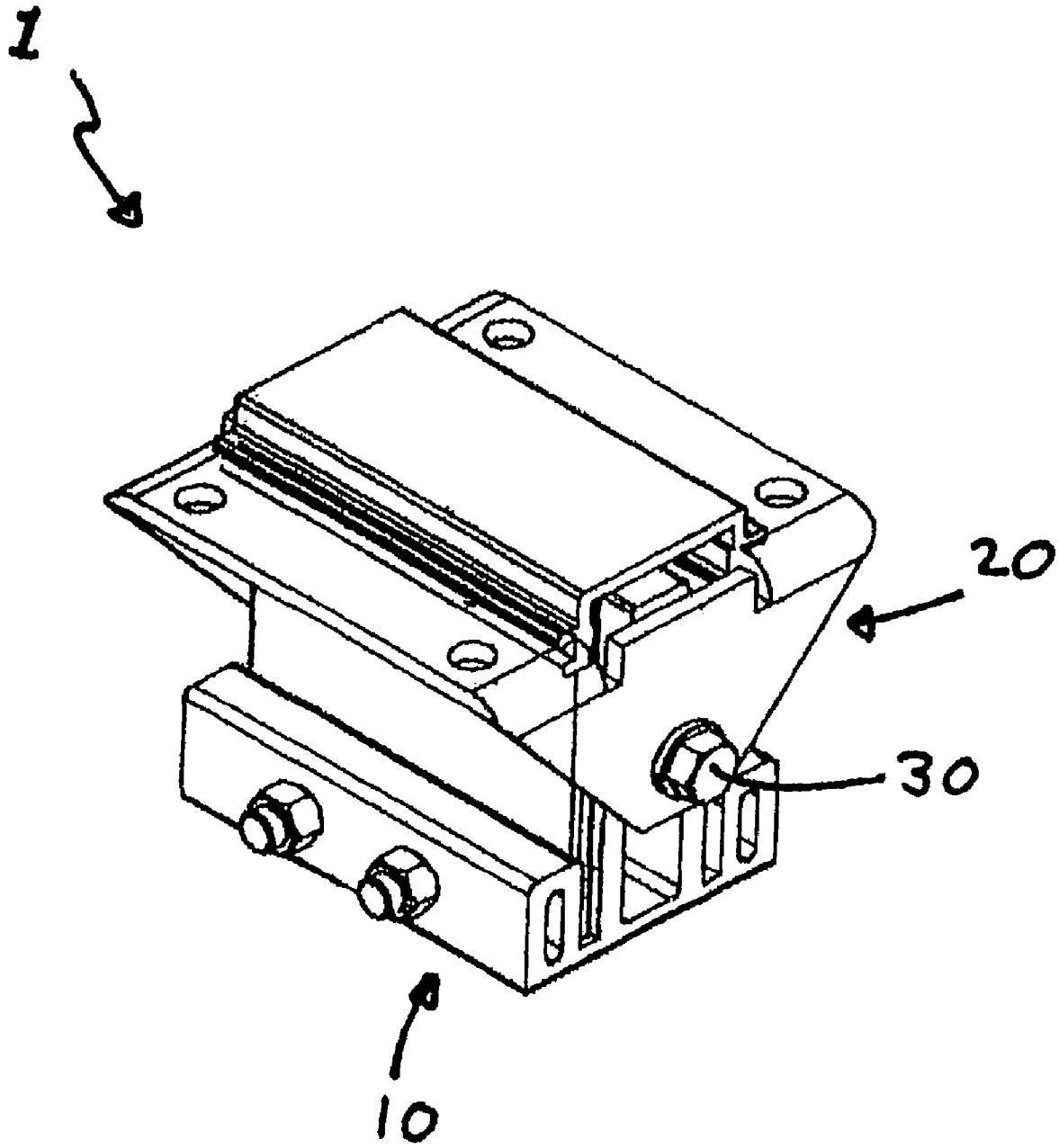
FIG. 2 shows a perspective view of the joint shown in FIG. 1.

In this embodiment, the joint 1 is designed as shown in FIG. 2, comprising two joint elements, one lower joint element 10 and one upper joint element 20 which are jointed via a horizontal shaft 30. The upper joint element 20 can be tilted between two extreme positions in relation to the lower joint element 10 which it is connected to.

The lower joint element 10 in this embodiment is substantially parallel to the surface. The lower joint element 10 will be arranged to an underframe 200.

The upper joint element 20 will be arranged to the seat of the chair, and is substantially parallel to the seat of the chair. A frame 50 is moulded within the padding of the chair and constitutes the means of attachment of the seat 100 to the upper joint element 20. In this embodiment the joint is integrated in the seat 100 of the chair. Advantages of an integrated joint are that crush injuries are prevented, no dirt enters into the joint and the furniture obtains a better visual appearance.

As an alternative, the upper face of the upper joint element 20 is applicable as an attachment face to the lower face of a chair seat or some other kind of fixture for the seat.

The joint 1 may be positioned in three main positions depending on the position of the centre of gravity of the user relative to the shaft 30, by the tilting of joint elements 10 and 20 in relation to each other.

Figure 3:
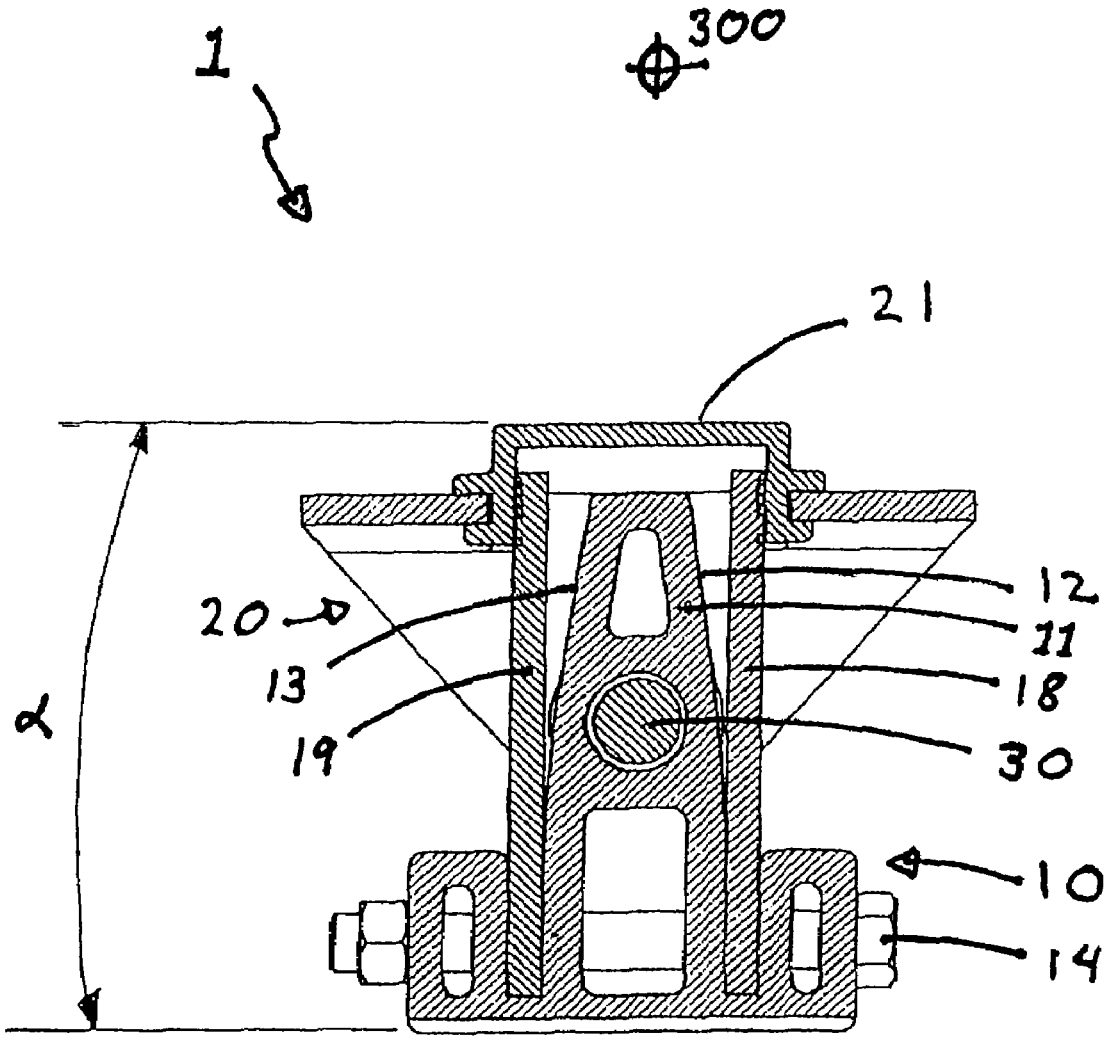
FIG. 3 shows a section of the joint in rest position.

In FIG. 3 the joint 1 is shown in the rest position where the centre of gravity 300 of the user is positioned in line with the shaft 30. Hence the joint 1 has a starting position $\alpha$ (between the upper face 21 of the joint and the surface), which can be any angle which is appropriate for the intended use, which in this embodiment for example is about 0° when the chair is used in an upright position.

As shown in FIG. 3 the lower joint element 10 is formed as a base with a rising block element 31 to which the shaft is connected through and two plate springs 18 and 19 on each side of the block element 11 parallel to the shaft 30. The springs 18 and 19 are based to the lower part of the lower joint element 10 by means of through bolts 14 transverse to the shaft 30.

Figure 4:
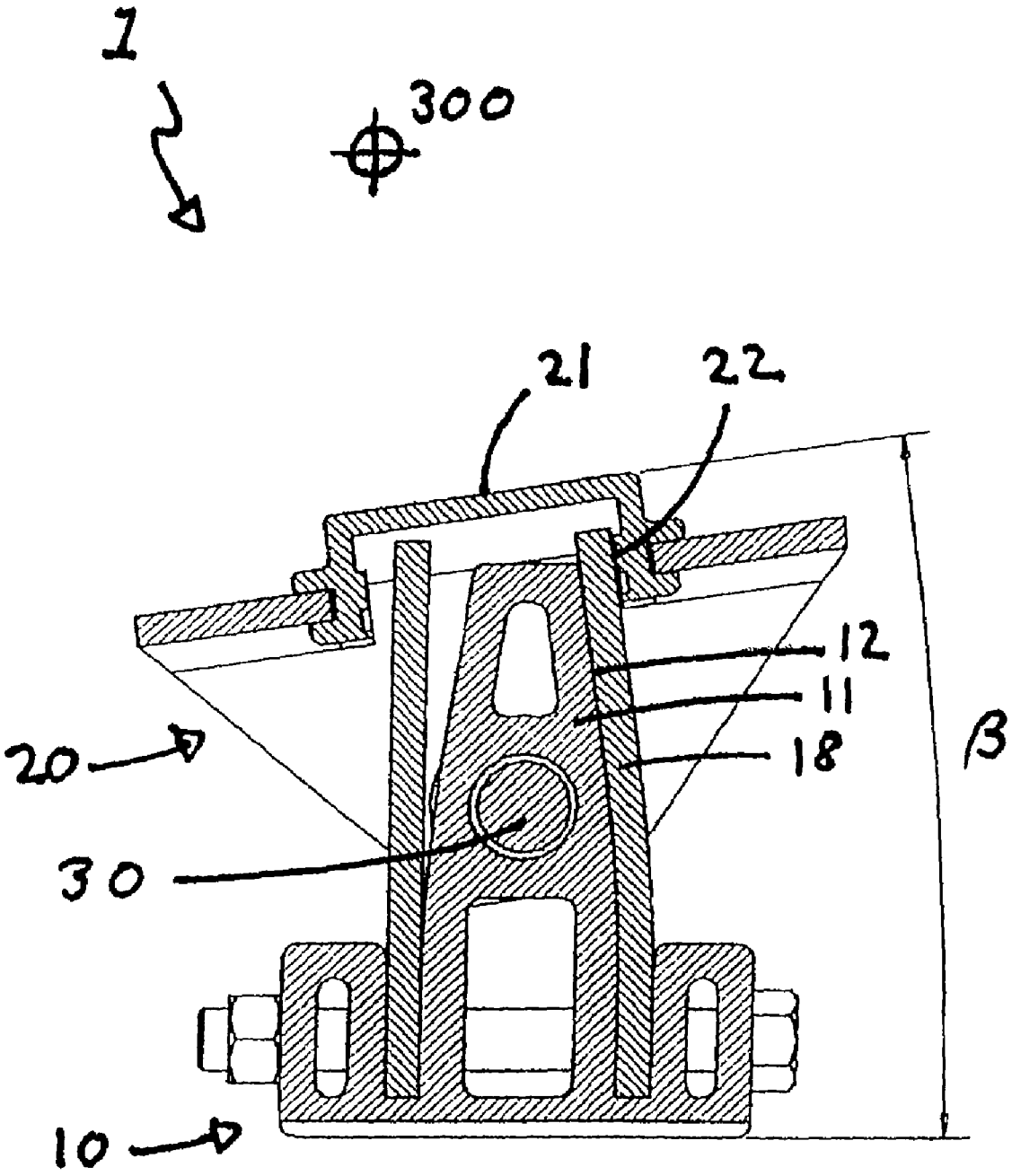
FIG. 4 shows a section of the joint in FIG. 1 in an alternative position.

In FIG. 4 the joint is shown in a forward tilted position, where the centre of gravity 300 of the user is positioned in front of the shaft 30. In this position the joint has an angle $\beta$, which in this embodiment for example is 8°. The spring 18 will in a forward tilted position like this provide a resistance to forward tilting of the upper joint element 20 due to the abutment of the abutting face 22 on the spring 18. The upper joint element 20 may be tilted forward until the spring 18 (and the upper joint element 20) abuts the rising block element 11. To distribute the tension on the spring 18, the abutting face of the block element is curved.

Figure 5:
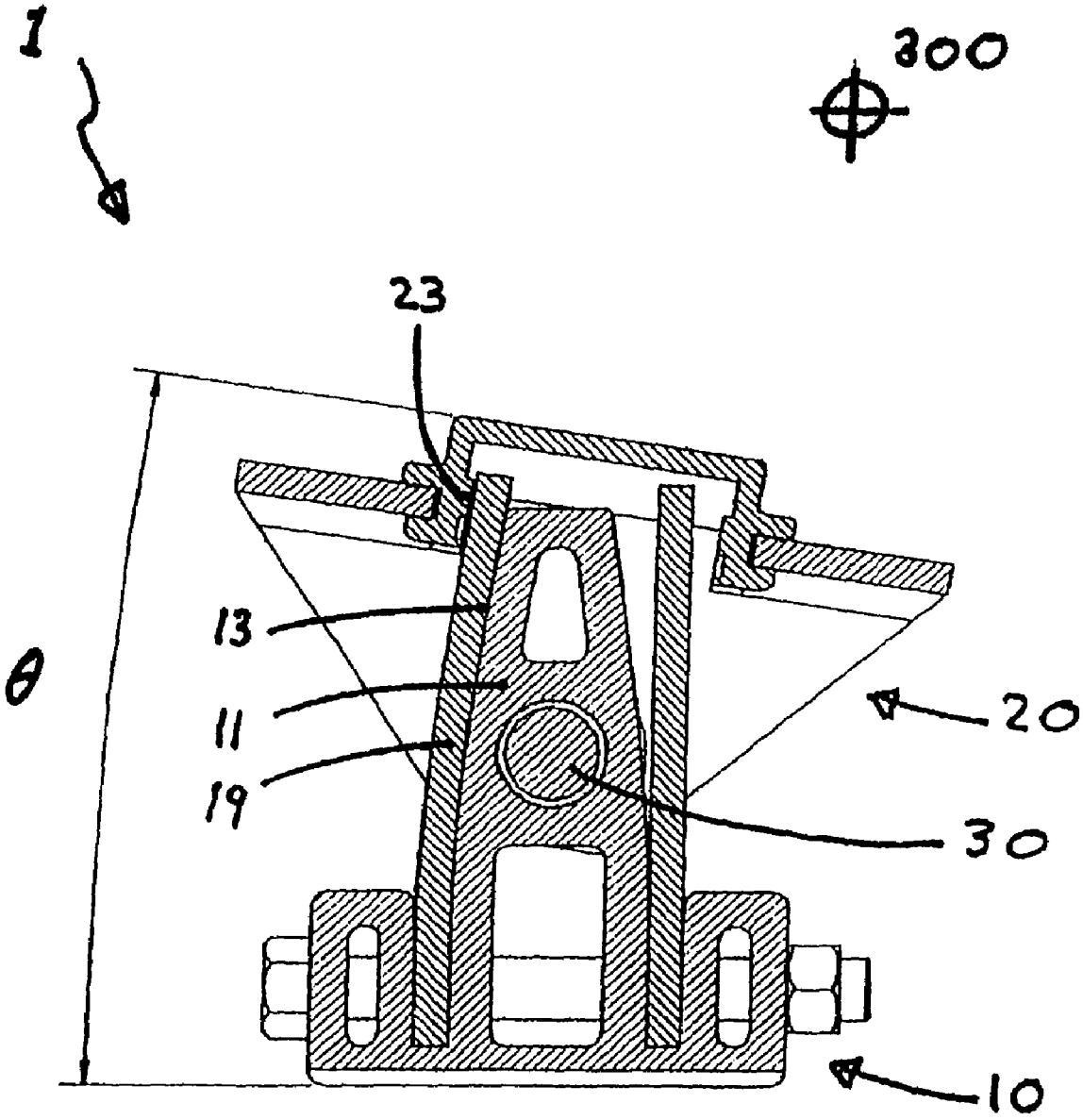
FIG. 5 shows a section of the joint in FIG. 1 in an alternative position.

In FIG. 5 the joint 1 is shown in a backward tilted position where the centre of gravity of the user is positioned behind the shaft 30. In this position the joint has an angle $\theta$, which in this embodiment for example is 8°. The spring 19 will, in the same manner described above, provide resistance to tilting of the upper joint element due to the abutment of the abutting face 23 on the spring 19. The upper joint element 20 may be tilted backwards until the spring 19 (and the upper joint element 20) abuts the rising block element 11 with the curved abutting face 13.

Hence the joint 1 possesses a spring resistance, which forces the upper part 20 towards its resting position and moves the chair back to the starting position when no force is exerted on it by the user. Furthermore, the springs 18, 19 will cushion the movement in joint 1 and provide smooth movement between the main positions. This provides comfortable movement and an improved preventive measure to avoid canting the chair.

Generally, the resistance of the spring should be adapted to the weight of the user, the weight of the seat, the angle between the seat and the back of the chair, and the assembly position of the seat relative to the joint.

The spring resistance in joint 1 is provided by springs 18, 19, which are preferably made of fibreglass. These springs may be produced very rigid, and are adjusted according to the conditions outlined above. The resistance of the springs can be adjusted by altering the thickness and width of the springs, the length or the height of the spring and optionally the joint, and the composition of materials in the spring. Optionally, the spring resistance may be adjusted by altering the distance between the shaft 30 and the fixings 14 of the springs 18, 19.

The rigidity of the fibreglass springs makes it possible to design a more compact joint compared to a similar joint using springs of steel. Preferably the springs are made of fibreglass, wherein different types may be utilized, and may be reinforced with different materials such as carbon, high-strength polymers, etc.

The inflection of the spring 18, 19 does not start at the level of the shaft 30 but is displaced from this level. This allows a longer curve of the spring than in usual conventional spring joints for chairs. Due to the difference in length of the lever of rotation for the spring 18, 19 and for the upper joint element 20, a certain transmission ratio is provided between the spring 18, 19 and the upper joint element.

The curved abutting faces 12, 13 are important to prevent the spring 18, 19 being over-stressed due to high stress at the fixing to the lower joint element 10, resulting in fracture of the spring.

Due to the displacement of the axis of rotation 30 of the joint at the shaft 30 in relation to the fixing of the springs, the springs will slide on the abutting faces 22, 23 of the upper joint element 20. Hence, a protective barrier may preferably be provided between these parts. Such a protective barrier can prevent wear and rubbing noises and optionally clicking noises, created by the contact between the abutting faces 22, 23 and the spring during rotation of the joint.

The lower joint element 10 may be provided with parts of a fixture, such as a guide means, to attach the joint 2 to a possible base or an underframe.

Likewise, the upper joint element 30 may be provided with an upper face 31 designed for attachment to a chair seat, for example by way of bolts and/or a rail device.

The preferred embodiment of the joint depends on the design of the chair seat, the angle of the back, the weight of the seat, the weight of the user, and possible limitations due to the design of the underframe. Furthermore, the relation of angles and distances will be affected by the resistance of the springs and the angle and the stiffness of the spring. In the above embodiment the size of the joint is for example 8 cm×10 cm×8 cm (height×width×length) in a start/resting position, and form a very compact joint. The joint parts 10, 20 can be made of any suitable material such as a metal, plastic material or a composite, preferably a metal such as steel or aluminium.

ALTERNATIVE EMBODIMENTS

In the above embodiment, the joint element is constructed such that the lower joint element 10 comprises a block element 11, which protrudes into the upper joint element 20, but the opposite is obviously also possible and the joint may be installed "upside-down". Hence, the upper joint element 20 may be provided with one or more block elements which protrude into the lower joint element 10, with corresponding abutment faces. Furthermore, a block element may comprise several protruding block elements which cooperate with corresponding structures in facing joints, such a construction may provide further abutting faces and renders a larger area of contact.

In an alternative embodiment the allowed backwards tilt angel can be greater than the allowed forward tilt angel. Furthermore, the resistance of the springs may be greater forwards than backwards, or vice versa. The deflections can be varied to accommodate any use, and may for example be in the range 5-10°.

In another alternative embodiment each spring 18, 19 may be divided into two or more parallel spring blades with different thicknesses in relation to each other. In this embodiment, the spring resistance will be progressive as the upper joint element 20 is rotated and connects with more spring blades subsequently during rotation. Alternatively, the parallel spring blades may be displaced in relation to each other, with difference in distance to the shaft 3, to obtain a similar effect.

Furthermore, the joint according to the invention may be used for any chair seat or furniture having any design. Such a chair may also be one without a back, e.g. a stool, where the user has a sitting position supported both at the knees and the behind.

Furthermore, the underframe may have any design and several chairs with joints 1 may for example be mounted in a row onto the same underframe to provide a bench-like row, a row of seats in a stadium, a cinema or a theatre etc.

The invention claimed is:

1. A mobile joint (1) suitable for a sitting device, comprising a first and second joint element (10, 20), which are pivotally connected by a shaft (30), to allow tilting forwards and backwards of the sitting device caused by the displacement of the users weight, wherein the mobile joint comprises a first and second parallel plate spring (18,19) with first and second ends, with an intermediate blocking element (11), wherein each plate spring (18,19) in the first end is connected to the first joint element (10), and in the second end is glidingly abutting the second joint element (20), the second joint element (20) is allowed to tilt forwards until the first plate spring (18) abuts the blocking element (11), the second joint element (20) is allowed to tilt backwards until the second plate spring (19) abuts the blocking element (11), the first and second plate spring (18,19) each having an axis of rotation that is displaced in relation to each other and the shaft (30).

2. The mobile joint (1) according to claim 1 wherein the springs (18, 19) abut curved faces (22, 23) on the blocking element (11) when deflected.

3. The mobile joint (1) according to claim 1, wherein the spring is adjustable by adjusting the distance from the axis of rotation of the shaft (30) to the connection of the springs (18, 19) to the first joint element (10).

4. The mobile joint according to claim 1, wherein the springs are made of fibreglass.

5. The mobile joint according to claim 4 wherein the fibreglass is reinforced by carbon and/or high-strength polymers.

6. The mobile joint according to claim 1, wherein the outside dimensions of the joint (1) are approximately 8 cm in height, 10 cm in width, and 8 cm in length.

7. The use of the mobile joint (1) formed according to one of the preceding claims in a chair comprising a seat device (100) and an underframe (200) wherein the mobile joint (1) connects the seat device (100) and the underframe (200).

8. The use according to claim 7 wherein the mobile joint (1) is integrated in the seat device (100).

* * * * *